US007603796B2

(12) United States Patent
Johnson, Jr.

(10) Patent No.: US 7,603,796 B2
(45) Date of Patent: Oct. 20, 2009

(54) BOOT WITH OVERSIZED TOE BOX FOR THERMAL INSULATION

(75) Inventor: William C. Johnson, Jr., Clarksville, TN (US)

(73) Assignee: Rocky Brands Wholesale, LLC, Nelsonville, OH (US)

( * ) Notice: Subject to any disclaimer, the term of this patent is extended or adjusted under 35 U.S.C. 154(b) by 0 days.

(21) Appl. No.: 09/977,463

(22) Filed: Oct. 15, 2001

(65) Prior Publication Data

US 2003/0070323 A1 Apr. 17, 2003

(51) Int. Cl.
*A43B 7/00* (2006.01)

(52) U.S. Cl. ..... 36/77 R; 36/72 R

(58) Field of Classification Search ..... 36/77 R, 36/77 M, 96, 72 R, 107
See application file for complete search history.

(56) References Cited

U.S. PATENT DOCUMENTS 2,814,888 A * 12/1957 Hill ..... 36/77 R
3,805,419 A * 4/1974 White ..... 36/77 R
4,102,062 A * 7/1978 Adams ..... 36/77 R
4,231,170 A * 11/1980 Griswold ..... 36/77 R
4,870,762 A * 10/1989 Lee ..... 36/77 R
4,908,963 A 3/1990 Krajcir et al.
5,150,536 A 9/1992 Strong
5,163,198 A * 11/1992 Herber ..... 36/77 M
5,689,903 A * 11/1997 Aumann ..... 36/77 R
5,711,093 A * 1/1998 Aumann ..... 36/77 R
5,737,857 A * 4/1998 Aumann ..... 36/77 R
6,029,373 A * 2/2000 Diradour et al. ..... 36/77 R
2001/0007179 A1* 7/2001 Mitchell ..... 36/77 R

FOREIGN PATENT DOCUMENTS

WO WO 92/14372 * 9/1992

* cited by examiner

*Primary Examiner*—Jila M Mohandesi
(74) *Attorney, Agent, or Firm*—Porter, Wright, Morris & Arthur, LLP

(57) ABSTRACT

A boot having an oversized toe box within which a layer of cold weather insulating material of increased thickness is provided.

13 Claims, 2 Drawing Sheets

BOOT WITH OVERSIZED TOE BOX FOR THERMAL INSULATION

FIELD OF THE INVENTION

This invention relates to footwear and in particular to boots, such as hunting boots, which may be worn for extended periods of time often in frigid conditions. The boot of the present invention provides improved cold weather insulation in the toe area.

DESCRIPTION OF THE PRIOR ART

A hunter in the field often experiences frigid conditions and hunting boots must have proper cold weather insulation, particularly in the toe area, for medical and comfort reasons. In certain prior art boots, as to which the present invention is an improvement, a waterproof bootie surrounded the wearer's foot and a relatively thin quilted layer of cold insulating material was located above the toe region of the bootie. A toe box, generally formed of plastic material, was located directly above the quilted layer of insulating material and in many instances, but not always, a thick layer of cold insulating material which provided the principal cold insulation for the boot overlied the toe box and waterproof bootie. A leather outer layer overlied the thick layer of cold insulating material.

The thick layer of cold insulating material referred to above included a volume of dead air which contributed to the thermal insulating qualities of the layer. In prior art boot construction, the leather was stretched over the toe box to prevent wrinkles in the leather and in doing so, the thick insulating layer was compressed causing a reduction in the volume of thermal insulating dead air. The reduction of dead air caused a reduction in the thick insulating layer of the boot.

While the relatively thin quilted layer of cold insulation material on the bootie was not compressed during boot construction and therefore retained its insulation efficiency, the size of the toe box limited the size of the quilted layer and its insulating effectiveness.

In addition to the prior art just described, the prior art included a safety shoe, U.S. Pat. No. 4,908,963, that comprised heat insulation material extending below both a metallic box toe and a metatarsal guard. An additional layer of heat protecting material extended over the metatarsal guard. The insulating or heat protecting material disclosed in the patent impeded heat, from entering the footwear. There also was disclosed in U.S. Pat. No. 5,150,536 an oversized boot in which the upper was lined with insulating material.

SUMMARY OF THE INVENTION

According to the present invention, a boot comprises an oversized toe box in which substantially more cold weather insulation is provided than in a boot having a conventional toe box. A clearer understanding of the invention will be had from consideration of the following description and drawings in which:

DESCRIPTION OF THE PREFERRED EMBODIMENT

A. The Prior Art

Figure 1:
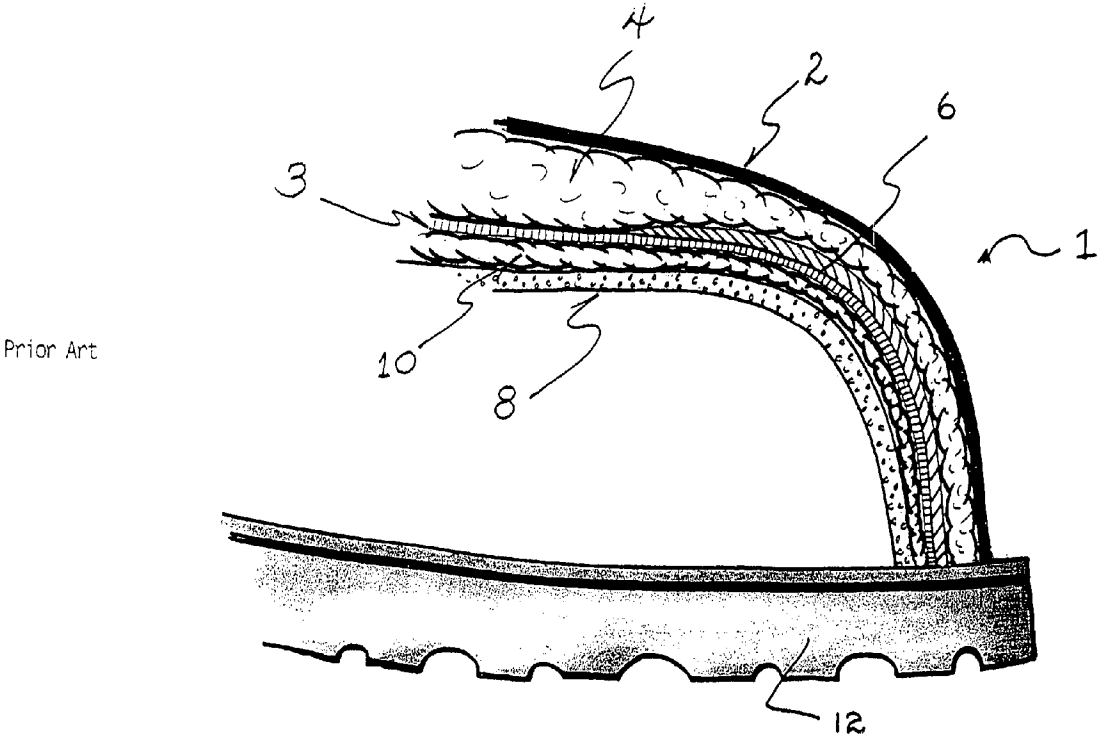
Prior Art FIG. 1
FIG. 1 is a sectional elevational view of the toe portion of a prior art boot.
Figure 2:
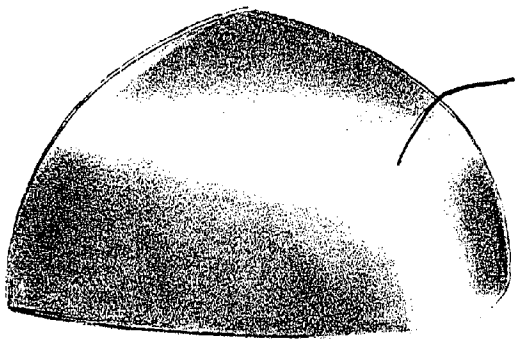
Prior Art FIG. 2
FIG. 2 is a perspective view of the plastic toe box incorporated in the prior art boot.

The toe portion 1 of a prior art boot shown in FIG. 1 and FIG. 2 comprises a leather outer layer 2 beneath which is a relatively thick layer of cold insulating material 4, such as, for example, the high loft fiber insulation sold by 3M corporation under the "Thinsulate" trademark. The original thickness of insulating layer 4 may vary between approximately 0.315 inches and 0.54 inches. When, however, the prior art boot is constructed, the leather outer layer 2 is stretched, either manually or mechanically, over the toe area to prevent wrinkles in the toe area. That stretching of the leather causes compression of the insulating layer 4 to a thickness of between approximately 0.119 inches and 0.276 inches. Compression of insulating layer 4 reduces the amount of dead air space therein and the corresponding thermal efficiency of insulating layer 4.

A plastic toe box 6 which may be formed of styrene is adhesively secured to the bottom of insulating layer 4. The plastic toe box 6 is formed from a flat sheet during the process in which the boot is lasted. While varying with fashion trends and functional requirements, it is common for the prior art plastic toe box 6, to have a maximum height of approximately 1.5 inches and a maximum length of approximately 1.75 inches. A vamp lining 3 extends below the insulating layer 4 and plastic toe box 6 and may be adhesively secured thereto. A waterproof bootie 8, formed for example, of material sold by W. L. Gore under the "Gore-Tex" trademark includes a relatively thin quilted layer 10 of cold insulating material above the toe region of the bootie 8. The thickness of the quilted layer 10 is generally about 0.24 inches. The quilted layer 10 is secured to the bootie 8 and is formed of 200 gram batting, i.e. a one inch thick layer of insulating material weighing 200 grams per square inch. The quilted layer 10 is secured to the underside of vamp 3 by suitable means such as latex cement. The leather outer layer 2, insulation layer 4, plastic toe box 6, vamp 3 and bootie 8 are attached to outsole 12 in known manner.

B. The Present Invention

Figure 3:
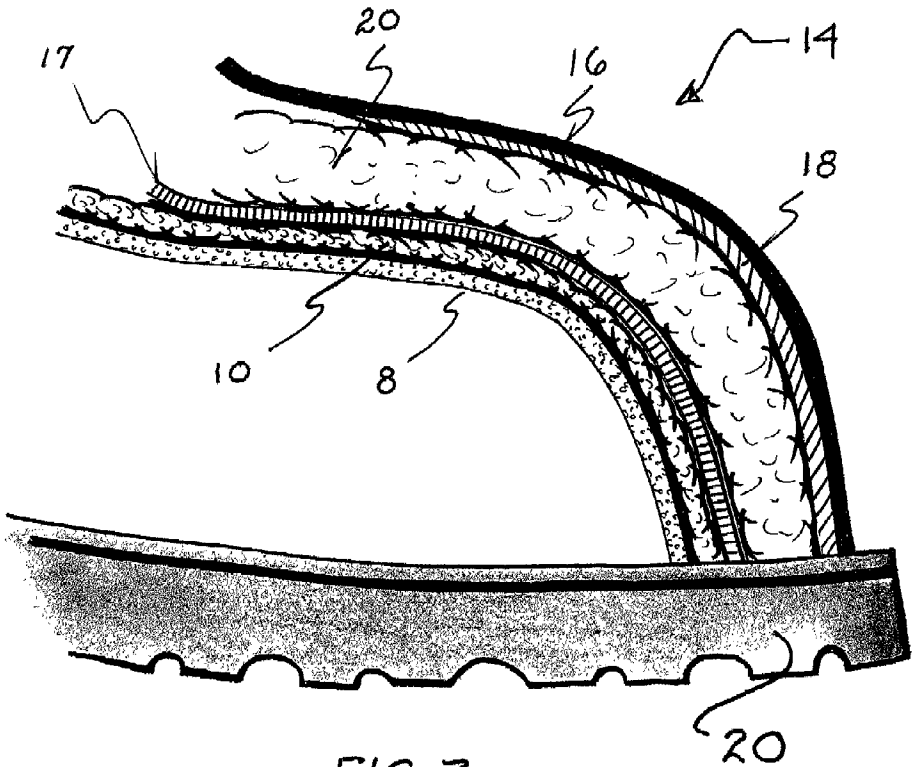
FIG. 3 is a sectional elevational view of the toe portion of the boot of the present invention.
Figure 4:
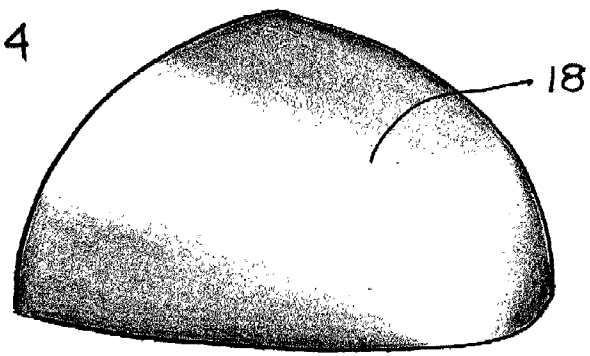
FIG. 4 is a perspective view of the oversized plastic toe box incorporated in the boot of the present invention.

The toe portion 14 of a boot of the present invention, shown in FIG. 3 and FIG. 4 comprises a leather outer layer 16 beneath which is an oversized plastic toe box 18, formed in the same manner as the plastic toe box 6 shown in FIG. 1 and FIG. 2. In the oversized plastic toe box 18, the height may vary between 1.9 inches and 2.5 inches, while the length may vary between 2.0 inches and 2.75 inches. A cold insulating layer 20, which is the same material as layer 4 in the boot of FIG. 1 and FIG. 2 is adhesively secured to the underside of the toe box 18. The interior of the toe box 18 is substantially larger than the interior of toe box 6 and therefore the cold insulating layer 20 is able to fit within toe box 18 while still allowing room for the wearer's toes. The smaller interior of prior art toe box 6 could not permit layer 4 to fit within toe box 6 and still allow room for the wearer's toes.

It will be understood that the cold weather insulating layer 20, because it is within toe box 18 is not compressed by the stretching of the leather over the toe area as was the cold insulating layer 4 in the prior art boot of FIG. 1. Thus, the amount of dead air space in cold insulating layer 20, and the consequent ability of cold weather insulating layer 20 to retain heat is not reduced as was the cold weather insulating layer 4. The thickness of cold weather insulation layer 20 may, for example, vary between 0.75 inches and 1.00 inches. It will be appreciated that the uncompressed cold insulating layer 20 provides superior cold weather insulation than does the compressed cold weather layer 4 of the prior art boot. A vamp lining 17 extends below insulating layer 20 and may be adhesively secured thereto. Another vamp lining (not shown) maybe adhesively secured to the underside of outer layer 16 for added strength, although any such vamp lining may adversely affect the breathability of the boot. Waterproof bootie 8, previously described, may be adhesively secured to the underside of vamp lining 17. Here again outer layer 16, plastic toe box 18, insulation layer 20, vamp lining 17 and bootie 8 are attached to outsole 24 in known manner.

This invention has been described above with reference to a presently preferred embodiment of the invention. The description, however, has not been presented as a catalog exhaustive of all forms which the invention may take. It will be understood that the size of the oversize plastic toe box 18 and the insulation layer 20 may be varied to satisfy the desired thermal insulation requirements of the boot. Accordingly, workers skilled in the art to which this invention pertains will readily appreciate that variations, alterations or modifications in the structure's procedures, and arrangements described above may be practiced without departing from the scope of this invention. This, the foregoing description should not be read as limiting the scope of this invention to less than the fair scope of the following claims.

What is claimed as novel and desired to be secured by Letters Patents is:

1. A boot, comprising:

an outer layer of stretchable leather;

an outsole;

an oversized toe box supported on the outsole and covered by the outer layer of stretchable leather, the toe box being sized to enclose a substantial thickness of compressible cold insulating material and the corresponding portion of a user's foot without compression of the cold insulating material when the boot is worn;

a layer of compressible cold insulating material in its uncompressed state, the cold insulating material located within the outer layer of stretchable leather outside the toe box and extending into the toe box and having a constant thickness in the toe box and an area outside the toe box and adjacent to the toe box, the cold insulating material secured to an underside of the toe box;

wherein the compressible cold insulating material is a high loft fiber insulation; and a lining having a first side facing the opposing surface of the cold insulating material and a second side generally facing the upper surface of a portion of a user's foot, the lining extending below the opposing surface of the cold insulating material a sufficient distance that the cold insulating material is not compressed between the toe box and the lining when the boot is worn.

2. The boot as recited in claim 1, further comprising:

a thinner layer of cold insulating material extending below the second side of the lining.

3. The boot as recited in claim 1, wherein the layer of compressible cold insulating material has a thickness in the range of 0.75 inches and 1.00 inches.

4. The boot as recited in claim 3, wherein the toe box has a height in the range of 1.9 inches and 2.5 inches and a length in the range of 2.0 and 2.75 inches.

5. The boot as recited in claim 1, wherein the toe box has a height in the range of 1.9 inches and 2.5 inches and a length in the range of 2.0 and 2.75 inches.

6. A boot, comprising:

an outer layer of stretchable leather;

an outsole;

an oversized toe box supported on the outsole and covered by the outer layer of stretchable leather, the toe box being sized to enclose a substantial thickness of compressible cold insulating material and the corresponding portion of a user's foot without compression of the cold insulating material when the boot is worn;

a layer of compressible cold insulating material in its uncompressed state, the cold insulating material located within the outer layer of stretchable leather outside the toe box and extending into the toe box and having a constant thickness in the toe box and an area outside the toe box and adjacent to the toe box, the cold insulating material secured to an underside of the toe box;

wherein the compressible cold insulating material is a high loft fiber insulation; and a lining having a first side facing the opposing surface of the cold insulating material and a second side generally facing the upper surface of a portion of a user's foot, the lining extending below the opposing surface of the cold insulating material a sufficient distance that the cold insulating material is not compressed between the toe box and the lining when the boot is worn;

a thinner layer of cold insulating material extending below the second side of the lining; and a waterproof membrane extending below the thinner layer of cold insulating material.

7. The boot as recited in claim 6, wherein the layer of compressible cold insulating material has a thickness in the range of 0.75 inches and 1.00 inches.

8. The boot as recited in claim 7, wherein the toe box has a height in the range of 1.9 inches and 2.5 inches and a length in the range of 2.0 and 2.75 inches.

9. The boot as recited in claim 6, wherein the toe box has a height in the range of 1.9 inches and 2.5 inches and a length in the range of 2.0 and 2.75 inches.

10. A boot, comprising:

an outer layer of stretchable leather;

a layer of compressible cold insulating material in its uncompressed state within the outer layer of stretchable leather;

wherein the cold insulating material is located outside the toe box and extends into the toe box and having a constant thickness in the toe box and an area outside the toe box and adjacent to the toe box, the cold insulating material secured to an underside of the toe box;

wherein the compressible cold insulating material is a high loft fiber insulation;

an outsole;

a toe box supported on the outsole and arranged between the layer of compressible cold insulating material and the outer layer of stretchable leather such that the cold insulating material is located outside the toe box and extends into the toe box, remains in an uncompressed state when the stretchable leather is stretched over the toe box, and the thickness of the cold insulating material is constant in the toe box and an area outside the toe box and adjacent to the toe box, the toe box being oversized to enclose a substantial thickness of compressible cold insulating material and the corresponding portion of a user's foot without compression of the cold insulating material either by the stretchable leather or by a user's foot when the boot is worn, the layer of cold insulating material being secured to an underside of the toe box; and a lining having a first side facing the opposing surface of the cold insulating material and a second side generally facing the upper surface of a portion of the user's foot, the lining extending below the opposing surface of the cold insulating material a sufficient distance that the cold insulating material is not compressed between the toe box and the lining when the boot is worn.

11. The boot as recited in claim 10, wherein the layer of compressible cold insulating material has a thickness in the range of 0.75 inches and 1.00 inches.

12. The boot as recited in claim 11, wherein the toe box has a height in the range of 1.9 inches and 2.5 inches and a length in the range of 2.0 and 2.75 inches.

13. The boot as recited in claim 10, wherein the toe box has a height in the range of 1.9 inches and 2.5 inches and a length in the range of 2.0 and 2.75 inches.

* * * * *